US011805359B2

(12) United States Patent
Pompei

(10) Patent No.: US 11,805,359 B2
(45) **Date of Patent: *Oct. 31, 2023**

(54) PRIVATE PERSONAL COMMUNICATIONS DEVICE

(71) Applicant: Frank Joseph Pompei, Wayland, MA (US)

(72) Inventor: Frank Joseph Pompei, Wayland, MA (US)

( * ) Notice: Subject to any disclaimer, the term of this patent is extended or adjusted under 35 U.S.C. 154(b) by 134 days.

This patent is subject to a terminal disclaimer.

(21) Appl. No.: 17/467,825

(22) Filed: Sep. 7, 2021

(65) Prior Publication Data

US 2021/0409864 A1 Dec. 30, 2021

Related U.S. Application Data

(63) Continuation of application No. 16/734,744, filed on Jan. 6, 2020, now Pat. No. 11,140,477.

(60) Provisional application No. 62/788,929, filed on Jan. 6, 2019.

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2430/20* (2013.01)

(58) Field of Classification Search
CPC ..... H04R 3/005; H04R 1/406
See application file for complete search history.

(56) References Cited

U.S. PATENT DOCUMENTS

| | | | | |
|---|---|---|---|---|
| 6,415,555 | B1 | 7/2002 | Montague | |
| 9,648,154 | B1 | 5/2017 | Hua et al. | |
| 2004/0114770 | A1* | 6/2004 | Pompei | H04R 5/02 381/77 |
| 2004/0208324 | A1 | 10/2004 | Cheung et al. | |
| 2004/0209654 | A1* | 10/2004 | Cheung | H04M 1/03 455/575.1 |
| 2005/0259831 | A1 | 11/2005 | Hutt et al. | |
| 2007/0183618 | A1 | 8/2007 | Ishii et al. | |
| 2007/0217616 | A1 | 9/2007 | Miyazaki | |
| 2009/0156249 | A1 | 6/2009 | Ruckart | |
| 2011/0103614 | A1* | 5/2011 | Cheung | G10L 21/0208 381/94.1 |
| 2013/0259254 | A1 | 10/2013 | Xiang et al. | |
| 2013/0304371 | A1 | 11/2013 | Kitatani et al. | |
| 2017/0195815 | A1 | 7/2017 | Christoph et al. | |
| 2017/0289684 | A1 | 10/2017 | Chang et al. | |
| 2018/0091916 | A1 | 3/2018 | Alexandropoulos | |
| 2018/0295461 | A1* | 10/2018 | Di Censo | H04S 7/303 |
| 2018/0295462 | A1 | 10/2018 | Di Censo et al. | |
| 2019/0394598 | A1 | 12/2019 | Moore | |

* cited by examiner

*Primary Examiner* — Simon King
(74) *Attorney, Agent, or Firm* — BainwoodHuang

(57) ABSTRACT

A personal communications device that employs directional or parametric speakers to provide an enhanced user experience, delivering audio directly to a user of the device rather than broadcasting the audio in all directions. In this way, increased privacy for the user of the personal communications device can be achieved.

17 Claims, 2 Drawing Sheets

PRIVATE PERSONAL COMMUNICATIONS DEVICE

CROSS-REFERENCE TO RELATED APPLICATIONS

This application is a continuation of U.S. patent application Ser. No. 16/734,744 filed Jan. 6, 2020 entitled PRIVATE PERSONAL COMMUNICATIONS DEVICE, which claims benefit of the priority of U.S. Provisional Patent Application No. 62/788,929 filed Jan. 6, 2019 entitled PRIVATE, PERSONAL COMMUNICATIONS DEVICE.

BACKGROUND

Personal communications devices, such as Amazon Echo™ smart speakers used with Amazon Alexa® virtual assistants, Google Voice™ telephone services, and so on, are becoming quite popular, and a wide variety of hardware for such devices is currently available. A typical personal communications device includes an array of microphones for receiving sound, and one or more speakers for transmitting sound. The microphone array is configured with standard beamforming techniques, such as phased array beamforming, noise and echo suppression, and similar techniques. The personal communications device is configured to receive spoken audio from a human user with minimal environmental noise being received.

SUMMARY

While reception techniques implemented by typical personal communications devices are primarily intended to minimize received noise, microphone arrays included in such devices can be used to estimate user position, direction, and/or bearing relative to the device, generally only requiring the devices to be programmed with appropriate software. When such direction or bearing information is known, directional or parametric speakers can be used with the devices to provide an enhanced user experience, delivering audio directly to users rather than broadcasting the audio in all directions. As a result, increased privacy for users of such personal communications devices can be achieved.

In certain embodiments, a personal communications device includes a base unit and a directional speaker. The base unit is configured to control the directional speaker for producing a directional sound field having a path directed toward a human user.

In certain arrangements, the personal communications device includes a microphone array configured to receive direction or bearing information associated with the human user.

In certain arrangements, the base unit is further configured to derive a location of the human user from at least the direction or bearing information received by the microphone array.

In certain arrangements, the personal communications device includes a pan/tilt gimbal component. The base unit is further configured to control the pan/tilt gimbal component based on the derived location of the human user, thereby aiming the directional speaker toward the human user so that he or she can privately hear sound produced by the personal communications device.

In certain embodiments, a method of a personal communications device includes receiving a spoken input signal produced by a human user at a microphone array of the personal communications device, estimating direction or bearing information pertaining to the human user by the personal communications device based at least on the received spoken input signal, and aiming a directional speaker associated with the personal communications device toward the human user in accordance with the direction or bearing information, allowing the human user to hear audio from the personal communications device privately.

Other features, functions, and aspects of the present disclosure will be evident from the Detailed Description that follows.

BRIEF DESCRIPTION OF THE DRAWINGS

The foregoing and other objects, features, and advantages will be apparent from the following description of particular embodiments of the present disclosure, as illustrated in the accompanying drawings in which like reference characters refer to the same parts throughout the different views.

DETAILED DESCRIPTION

The disclosures of U.S. patent application Ser. No. 16/734,744 filed Jan. 6, 2020 entitled PRIVATE PERSONAL COMMUNICATIONS DEVICE and U.S. Provisional Patent Application No. 62/788,929 filed Jan. 6, 2019 entitled PRIVATE, PERSONAL COMMUNICATIONS DEVICE are hereby incorporated herein by reference in their entirety.

A personal communications device is disclosed that employs a directional or parametric speaker to provide an enhanced user experience, delivering audio directly to a human user of the device rather than broadcasting the audio in all directions. As a result, increased privacy for the user of the personal communications device can be achieved.

Figure 1:
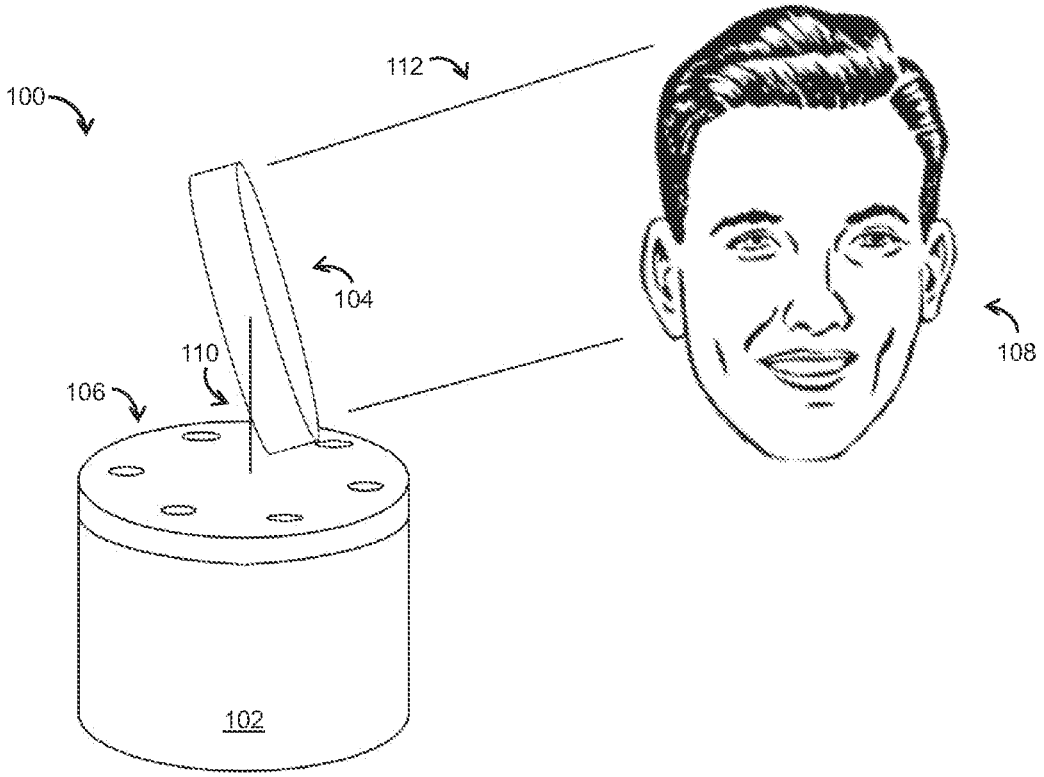
FIG. 1 is a block diagram of an exemplary personal communications device, in accordance with the present disclosure.

FIG. 1 depicts an illustrative embodiment of an exemplary personal communications device 100. As shown in FIG. 1, the device 100 can include a base unit 102 and a directional (or parametric) speaker 104, such as the Audio Spotlight® directional speaker sold by Holosonic Research Labs, Inc., Watertown, Mass. USA. The base unit 102 can be implemented using the Amazon Echo™ smart speaker sold by Amazon.com Inc., Seattle, Wash., USA, or any other suitable device. The base unit 102 can be configured with a microphone or microphone array 106. The device 100 can further include a pan/tilt gimbal 110 configured to pan and/or tilt the directional speaker 104 in substantially any direction, allowing the directional speaker 104 to produce a directional sound field 112 having a path that can be aimed directly toward a human user 108 or other private speaker and/or listener.

The base unit 102 can be further configured to house electronics (including processor and memory components), a power supply, and/or other similar components. The position and/or location of the user 108 can be derived from direction or bearing information provided by the microphone array 106, such that when the user 108 speaks (i.e., "Hello Alexa"), the microphone array 106 can receive the spoken input signal and estimate the direction/bearing of the user 108 as he or she interacts with the device 100. Once the direction/bearing information is known, the pan/tilt gimble 110 can aim the directional speaker 104 directly toward the user 108, allowing him or her to hear audio from the device 100 privately. For example, such direction/bearing information can be estimated using the microphone array 106 by comparing signal arrival time/phases and/or amplitude differences between the respective microphone array elements.

As an alternative (or addition) to directly panning/tilting the directional speaker 104 by the pan/tilt gimble 110, a multi-directional phased array can be used to direct an ultrasound or acoustic beam produced by the directional speaker 104, and thus a resulting audio beam, along a desired path, without requiring mechanical motion of the directional speaker 104. A lower cost one-dimensional phased array can also be used to aim the acoustic beam along a first directional axis, while mechanical steering can be employed to aim the acoustic beam along a second directional axis. Alternatively (or in addition), instead of aiming the directional speaker 104 directly toward the human user 108, a reflector can be employed to redirect the acoustic beam.

Such a reflector can be configured to include a hard surface to allow good reflection of soundwaves and acceptable directivity to be maintained. For example, an aesthetically pleasing, clear reflector made of hard plastic may be employed. The directional speaker 104 can be positioned on top of the base unit 102 and aimed upward, so that the soundwaves reflect from the reflector (which can move) to direct sound to an intended listening location. Other variations or additions are possible, including restricting the maximum angles (e.g., when the base unit 102 is near a wall, or the user's location is restricted to a known directional range), or using multiple speakers and/or reflectors to provide multiple different directional ranges. The reflector (and/or the directional speaker 104) can be curved to tailor the geometry of the resulting audio beam, much like light can be tailored by a lens or mirror.

In certain implementations, the base unit 102 can further include traditional speaker(s) for reinforcing low frequency content, since the bandwidth of the directional speaker 104 may be limited. Such traditional speaker(s) can provide for the option of an omnidirectional (i.e., public) mode of listening, as in currently available devices. Public or private mode can be selected by the human user 108 (e.g., "Alexa, private please," "Alexa, public please"). Public or private mode can also be selected automatically by analyzing the type of request and the context in which it was made, including the type of information to be delivered, e.g., whether or not it should be considered private information and/or whether there are other people nearby, which can be detected in any number of ways (e.g., by video, voice, infrared, device presence, etc.).

In certain implementations, the directional speaker 104 (or reflector) can contain one or more microphones to improve the reception of spoken audio from the human user 108, particularly in the presence of noise. Since it can move to aim the directional sound field path toward the user 108, the position of the directional speaker 104 can be better optimized to capture the spoken audio from the user 108 compared to the stationary microphone array 106.

In certain implementations, the base unit 102 can be configured to deliver sound-masking signals (essentially pink noise) to enhance the privacy of the directional acoustic beam, particularly in a quiet room. The personal communications device 100 can detect if the room is quiet by monitoring the microphone inputs, and can automatically adjust the sound-masking signal to provide enhanced privacy, without creating additional noise. As the sound-masking signal is known (it is generated by the base unit 102), it can be subtracted from the microphone input(s) to assure consistent reception quality. The sound-masking level can also be adjusted based on the reproduced level of the directional acoustic beam, and can be reduced or interrupted while the user 108 is speaking. For example, the sound-masking signal can be noise, music, voice or voice-like sounds, and/or any other suitable sound(s) that can mask the intended private communications.

In certain implementations, the personal communications device 100 or multiple such devices can be used in a conference room environment. For example, each conference participant can have his or her own directional (private) sound and/or microphone receivers, allowing him or her to hear the voice of a remote conference participant clearly and privately. The microphone array of the device 100 can allow the remote conference participant to speak softly and still be heard by the other conference participants. This can allow a private conference room to be configured "without walls."

In certain implementations, the position and/or location of the human user 108 can be tracked using the microphone array 106, as described herein. As an alternative (or in addition), a camera can be employed to follow, track, and/or detect the position and/or location of the human user 108 using facial recognition, LIDAR, IR, and/or any other suitable technique. Resulting tracking data can be used to aim the directional speaker 104 toward the user 108. It is noted that tracking devices can be optionally mounted to a moving/pivoting surface provided by the directional speaker 104 and/or the reflector.

In certain implementations, the personal communications device 100 (or a modification thereof) can be used as a special effects speaker for movies and/or video games, allowing sounds to literally "fly by" the human user's face or be projected overhead (e.g., atmos/DTS-X formats) to precise locations. The directional speaker 104 can also be combined with a traditional home theater system or speaker to provide enhanced effects, used on its own for better listening privacy without headphones, and/or provide additional sound(s) to the hearing impaired without subjecting others to increased loudness. Further, the human user 108 can tell the device 100 to switch between private listening mode or community listening mode.

It is noted that content delivered to the human user 108 by the personal communications device 100 can be television signals, music, information (e.g., from a virtual assistant), and/or any other suitable content. The personal communications device 100 can be placed on a tabletop, next to (or part of) a television, or mounted on the wall, ceiling, or floor. The device 100 can be used for discreet paging or similar communications within a public area. Multiple such devices can be used together, for example, for covering an increased area with sound communications. Such devices can be configured to "hand off" to each other as the user 108 moves throughout the area. Multiple such devices can also operate together to increase power and/or frequency range, or split the acoustic beam(s) to enhance privacy such that the sum of multiple beams is intelligible but each individually is unintelligible. With suitable signal processing, the device 100 can send a noise-cancelling signal to a specific user location for a quieter environment.

Figure 2:
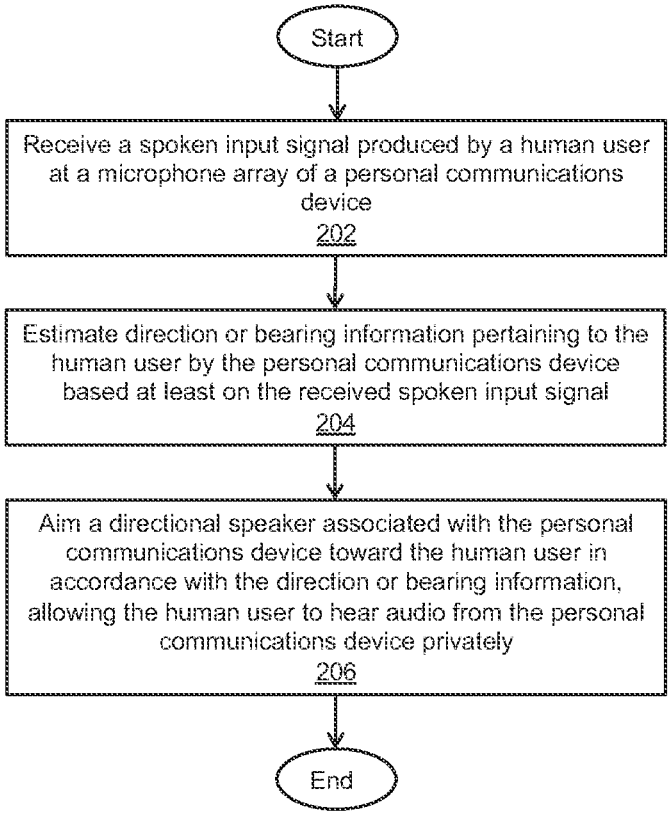
FIG. 2 is a flow diagram of an exemplary method of the personal communications device of FIG. 1.

An exemplary method of a personal communications device is described below with reference to FIG. 2. As depicted in block 202, a spoken input signal produced by a human user is received at a microphone array of the personal communications device. As depicted in block 204, direction or bearing information pertaining to the human user is estimated by the personal communications device based at least on the received spoken input signal. As depicted in block 206, a directional speaker associated with the personal communications device is aimed toward the human user in accordance with the direction or bearing information, allowing the human user to hear audio from the personal communications device privately.

While various embodiments of the present disclosure have been particularly shown and described, it will be understood by those skilled in the art that various changes in form and details may be made therein without departing from the scope of the present disclosure, as defined by the appended claims.

What is claimed is:

1. A personal communications device, comprising:

a base unit;

a directional speaker, wherein the base unit is configured to control the directional speaker for producing a directional sound field having a path directed toward a location;

a traditional nondirectional speaker, wherein the base unit is further configured to allow a selection between a private mode of listening using the directional speaker and a public mode of listening using the traditional nondirectional speaker; and a pan/tilt gimbal component configured to pan and/or tilt the directional speaker, wherein the base unit is further configured to direct the path of the directional sound field toward the location by controlling the pan/tilt gimbal component based on the location.

2. A personal communications device, comprising:

a base unit;

a directional speaker, wherein the base unit is configured to control the directional speaker for producing a directional sound field having a path directed toward a location; and a traditional nondirectional speaker, wherein the base unit is further configured to allow a selection between a private mode of listening using the directional speaker and a public mode of listening using the traditional nondirectional speaker, wherein the directional speaker is configured to produce a sound beam along the path directed toward the location, and wherein the base unit is further configured to generate a sound masking signal, and to perform one or more of adjusting a level of the sound masking signal based on a reproduced level of the sound beam, and adjusting the level of the sound masking signal or interrupting the sound masking signal based on a level of ambient noise.

3. A personal communications device, comprising:

a base unit;

a directional speaker, wherein the base unit is configured to control the directional speaker for producing a directional sound field having a path directed toward a location; and a traditional nondirectional speaker, wherein the base unit is further configured to allow a selection between a private mode of listening using the directional speaker and a public mode of listening using the traditional nondirectional speaker; and wherein the base unit is further configured to automatically select between the private mode of listening using the directional speaker and the public mode of listening using the traditional nondirectional speaker based on one or more of an audible request from a human user, a context or type of information to be audibly delivered to the human user, and whether individuals other than the human user are nearby.

4. The personal communications device of claim 3 further comprising:

a microphone array configured to receive direction or bearing information, wherein the base unit is further configured to derive the location from at least the direction or bearing information.

5. The personal communications device of claim 3 wherein the base unit is further configured to derive the location from video, voice, or infrared information.

6. The personal communications device of claim 3 wherein the directional speaker is a parametric speaker.

7. The personal communications device of claim 6 wherein the parametric speaker is configured to produce an ultrasonic or acoustic beam along the path directed toward the location.

8. The personal communications device of claim 3 wherein the directional speaker includes a multi-directional phased array configured to steer an ultrasonic or acoustic beam toward the location.

9. The personal communications device of claim 3 wherein the base unit is further configured to detect whether the individuals are nearby using video, voice, infrared, and/or device presence techniques.

10. The personal communications device of claim 3 wherein the base unit is configured to be incorporated with one of the directional speaker and the traditional nondirectional speaker.

11. A method of a personal communications device, comprising:

controlling, by a base unit, a directional speaker for producing a directional sound field having a path directed toward a location; and selecting, via the base unit, between a private mode of listening using the directional speaker and a public mode of listening using a traditional nondirectional speaker, wherein the controlling of the directional speaker includes one or more of panning and/or tilting the directional speaker by a pan/tilt gimbal component based on the location, redirecting a sound beam produced by the directional speaker by a reflector, restricting a maximum directional angle of the directional speaker, and restricting a directional range of the location.

12. A method of a personal communications device, comprising:

controlling, by a base unit, a directional speaker for producing a directional sound field having a path directed toward a location; and selecting, via the base unit, between a private mode of listening using the directional speaker and a public mode of listening using a traditional nondirectional speaker, wherein the directional speaker is configured to produce a sound beam along the path directed toward the location, and wherein the method further comprises:

generating a sound masking signal by the base unit; and performing one or more of adjusting a level of the sound masking signal based on a reproduced level of the sound beam, and adjusting the level of the sound masking signal or interrupting the sound masking signal based on a level of ambient noise.

13. A method of a personal communications device, comprising:

controlling, by a base unit, a directional speaker for producing a directional sound field having a path directed toward a location; and selecting, via the base unit, between a private mode of listening using the directional speaker and a public mode of listening using a traditional nondirectional speaker; and automatically selecting, via the base unit, between the private mode of listening using the directional speaker and the public mode of listening using the traditional nondirectional speaker based on one or more of an audible request from a human user, a context or type of information to be audibly delivered to the human user, and whether individuals other than the human user are nearby.

14. The method of claim 13 further comprising:

receiving direction or bearing information at a microphone array; and deriving the location from at least the direction or bearing information.

15. The method of claim 13 further comprising:

receiving video, voice, or infrared information; and deriving the location from at least the video, voice, or infrared information.

16. The method of claim 13 further comprising:

producing, by the directional speaker, an ultrasonic or acoustic beam along the path directed toward the location.

17. The method of claim 13 wherein the directional speaker includes a multi-directional phased array, and wherein the method further comprises:

steering, by the multi-directional phased array, an ultrasonic or acoustic beam toward the location.

* * * * *